US005735206A

United States Patent [19]

Rossini

[11] Patent Number: 5,735,206

[45] Date of Patent: Apr. 7, 1998

[54] DEFORMABLE MANDRELS FOR ROTARY PRINTING CYLINDERS

[75] Inventor: Felice Rossini, Milan, Italy

[73] Assignee: Erminio Rossini, sPa, Milan, Italy

[21] Appl. No.: 613,897

[22] Filed: Mar. 11, 1996

[30] Foreign Application Priority Data

Mar. 20, 1995 [IT] Italy ..... MI95A0543 U

[51] Int. Cl.[6] ..... B41F 13/08

[52] U.S. Cl. ..... 101/216; 101/375

[58] Field of Search ..... 101/216, 375, 101/153; 492/4, 45; 29/895.23

[56] References Cited

U.S. PATENT DOCUMENTS

| | | | |
|---|---|---|---|
| 2,365,980 | 12/1944 | Thomas . | |
| 3,015,268 | 1/1962 | Garrett . | |
| 3,043,211 | 7/1962 | Appenzeller . | |
| 3,146,709 | 9/1964 | Bass et al. . | |
| 3,166,013 | 1/1965 | Wyllie et al. | 101/378 |
| 3,253,323 | 5/1966 | Saueressig | 101/415.1 |
| 3,457,617 | 7/1969 | Noe et al. | 29/113 R |
| 3,475,803 | 11/1969 | Hill . | |
| 3,610,146 | 10/1971 | Willmott | 101/216 |
| 3,673,025 | 6/1972 | Fukuyama et al. . | |
| 3,959,574 | 5/1976 | Seanor et al. . | |
| 3,978,254 | 8/1976 | Hoexter et al. . | |
| 4,030,415 | 6/1977 | Fellows . | |
| 4,044,678 | 8/1977 | Rasmussen . | |
| 4,089,265 | 5/1978 | White et al. . | |
| 4,119,032 | 10/1978 | Hollis . | |
| 4,144,812 | 3/1979 | Julian . | |
| 4,144,813 | 3/1979 | Julian . | |
| 4,242,781 | 1/1981 | Takigawa et al. | 19/113 |
| 4,296,172 | 10/1981 | Hill . | |
| 4,381,709 | 5/1983 | Katz . | |
| 4,386,566 | 6/1983 | Moss | 101/375 |
| 4,496,434 | 1/1985 | Morssikhof . | |
| 4,503,769 | 3/1985 | Andersen . | |

(List continued on next page.)

FOREIGN PATENT DOCUMENTS

| | | |
|---|---|---|
| 278017A1 | 8/1988 | European Pat. Off. . |
| 384104B1 | 9/1994 | European Pat. Off. . |
| 623466A3 | 11/1994 | European Pat. Off. . |
| A1229548 | 12/1966 | Germany . |
| 8532300 | 2/1986 | Germany . |
| A3525045 | 1/1987 | Germany . |
| 1188238 | 1/1988 | Italy . |
| 57-107845 | 7/1982 | Japan . |

OTHER PUBLICATIONS

Papier & Kunststoff Verarbeiter, vol. 23, No. 9, Sep. 1988, Frankfurt DE. pp. 40 42 44 XP002006545 E. Schulz: "Nahtlose Fotopolymer–Druckwalzen nach dem Hulsenprinzip".

Zeitschrift "druck print Dec. 1987" Seite 20 bis 22 (trade journal).

Zeitschrift "EFM/Sep. 1987", Seite 22 bis 24 (trade journal).

Patent Abstracts of Japan, vol. 6, No. 201 (M–163), 13 Oct. 1982 & JP–A–57 107842 (Dainippon Printing Co. Ltd.).

(List continued on next page.)

*Primary Examiner*—Edgar S. Burr
*Assistant Examiner*—Daniel J. Colilla
*Attorney, Agent, or Firm*—Dority & Manning

[57] ABSTRACT

A printing cylinder mandrel (1) arranged to support a sleeve mounted on it and carrying the print characters, the mandrel (1) being surface-deformable and able to assume at least two configurations, in one of which the sleeve can be mounted on it and in the other of which the sleeve is torsionally locked to it, the mandrel (1) comprising a core (2) the surface of which is covered with a deformable element (8), between this latter and said core there being provided a plurality of intercommunicating perimetral chambers (10) containing an incompressible fluid; the mandrel (1) internally houses presser means (20) arranged to pressurize said fluid in order to achieve the surface deformation of the mandrel (1) and the torsional coupling and locking of the sleeve, said presser means (20) being guidedly movable within the mandrel (1) and being activated by feeding into this latter a pressurized fluid.

9 Claims, 1 Drawing Sheet

U.S. PATENT DOCUMENTS

Figures 1A, 1B, 2A, 2B:
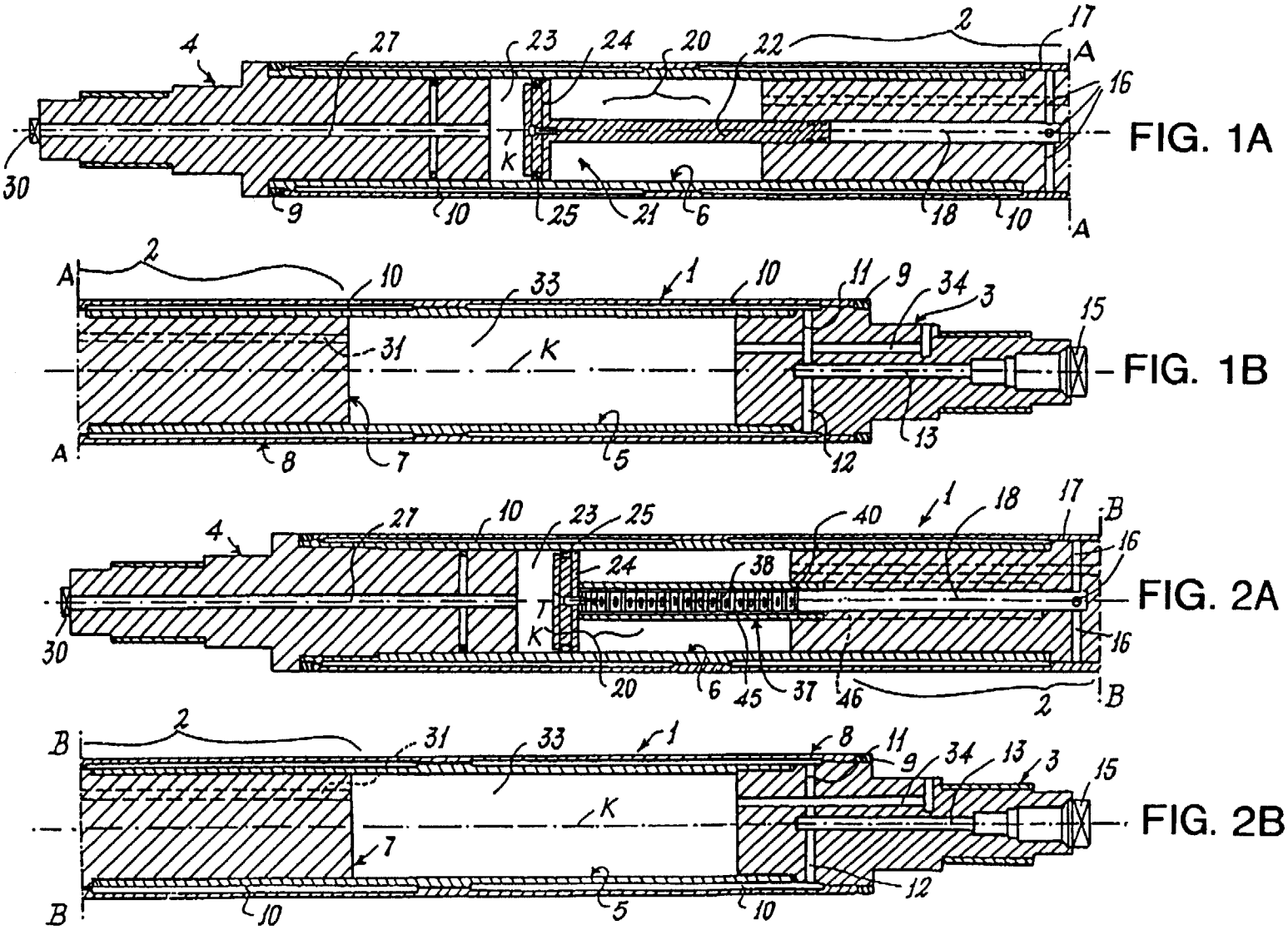

| | | | |
|---|---|---|---|
| 4,554,040 | 11/1985 | van der Velden . | |
| 4,794,858 | 1/1989 | Katz . | |
| 4,903,597 | 2/1990 | Hoage et al. . | |
| 4,934,266 | 6/1990 | Fantoni | 101/375 |
| 5,206,992 | 5/1993 | Carlson et al. . | |
| 5,316,798 | 5/1994 | Tittgemeyer . | |
| 5,544,584 | 8/1996 | Thompson et al. . | |

OTHER PUBLICATIONS

Nouvelles Graphiques, vol. 38, No. 18, Oct. 1988, Deurne BE. pp. 20 24 25 XP002006546 A. Vermeire: "Stork Revolutionne la Serigraphie avec ses manchons la trame Himesh".

Patent Abstracts of Japan, vol. 6, No. 201 (M-163), 13 Oct. 1982 & JP-A-57 107843 (Dainippon Printing Co. Ltd.).

DEFORMABLE MANDRELS FOR ROTARY PRINTING CYLINDERS

This invention relates to a printing cylinder mandrel of the surface-deformable type.

Various types of printing cylinders are known. In particular, cylinders are known comprising a sleeve mounted on a mandrel which is deformable, in the sense of having an outer diameter which can be varied to enable the sleeve (carrying the print characters) to be mounted on it, and then locked. A cylinder of this type is for example the subject of Italian patent 1188238.

However, cylinders of the aforesaid type have various drawbacks, including considerable constructional complexity, limited reliability and high cost.

In the printing cylinder described in the aforesaid patent, a deformable covering is provided on a mandrel core. Between the mandrel core and the covering a plurality of intercommunicating peripheral chambers are provided containing an incompressible fluid (oil) which, when pressurized, deforms the covering and hence changes the outer diameter of the mandrel. The incompressible fluid is pressurized by operating a screw (or similar member) positioned on one side of the mandrel.

This known arrangement has the main drawback of being difficult to use in that operating the screw (or similar member) to pressurize the incompressible fluid becomes increasingly more difficult as the fluid pressure increases. This means that the pressure required to lock the sleeve onto the mandrel may be unattainable, with the consequent possibility of relative slippage between these parts, leading to obvious consequences. Other printing cylinders are known in which the mandrel (of a type structurally similar to that of the subject of the aforesaid patent) is deformable by feeding pressurized oil from the outside into the peripheral chambers (already containing an identical fluid). This arrangement is simpler to use than the other described prior art, but has the serious drawback of possible leakages at the point in which the pressurized oil enters (where a non-return valve is provided). In such a case, should this happen during the use of the printing cylinder, the outer diameter of the mandrel would decrease, with consequent relative slippage between it and the sleeve, leading to obvious consequences.

In addition, hydraulic circuits must be provided associated with the printing machine to be able to pressurize the oil in the mandrel and release its pressure. This means that the printing machine has to be modified, with considerable cost and difficulty.

An object of the invention is to provide a deformable mandrel for a printing cylinder which overcomes the drawbacks of similar known mandrels.

A particular object of the present invention is to provide a mandrel of the stated type which can be deformed in a simple, fast, safe and reliable manner.

A further object is to provide a mandrel of the stated type which is of simple construction and can be used reliably in a printing machine.

A further object is to provide a deformable mandrel, the use of which does not require any modification to be made to the printing machine.

These and further objects which will be apparent to the expert of the art are attained by a deformable mandrel in accordance with the accompanying claims.

The present invention will be more apparent from the accompanying drawing, which is provided by way of non-limiting example and in which:

FIG. 1*a* is a longitudinal cross-sectional view of one end of a first embodiment of a mandrel according to the present invention broken at A—A;

FIG. 1*b* is a longitudinal cross-sectional view of the opposite end of the embodiment of the mandrel shown in FIG. 1*a* and broken at A—A;

FIG. 2*a* is a longitudinal cross-sectional view of one end of a second embodiment of a mandrel according to the present invention broken at B—B; and FIG. 2*b* is a longitudinal cross-sectional view of the opposite end of the embodiment of the mandrel shown in FIG. 2*a* and broken at B—B.

With reference to FIGS. 2*a* and 1*b*, a deformable mandrel is indicated overall by 1 and comprises a core 2 comprising end elements 3 and 4 associated in known manner with tubular elements 5 and 6 connected to a central element 7. The core 2 is covered with a deformable surface element 8 defined by a tubular element constructed of a metal of suitable elasticity (such as harmonic steel) fixed, for example by end welds 9, to said elements 3 and 4 and covering the elements 5, 6 and 7. Between the covering 8 and at least the tubular elements 5, 6 there are provided a plurality of similar intercommunicating perimetral chambers 10 containing an incompressible fluid, such as oil. One of the chambers 10 communicates with ducts 11 and 12 provided within the end element 3. These ducts branch radially from a duct 13 extending along the axis K of the mandrel 1. The duct 13 terminates at a known valve member 15 (for example a non-return valve) by which said duct can be connected to a circuit, of known type and not shown, for feeding oil into the mandrel 1. Oil is fed through the duct 13 into the annular chambers 10 on constructing the mandrel.

The central element 7 comprises radial ducts 16 communicating with channels 17 positioned parallel to the outer surface of the mandrel core 2 and connecting two adjacent chambers 10 together. The ducts 16 are connected to a channel 18 provided in said element 7 along the mandrel axis K, and hence containing oil (the same oil as that present in the chambers 10). Presser means 20 guidedly movable within the mandrel 1 press against this oil. Said means consist of a piston 21 comprising a rod 22 inserted into and slidable within the channel 18. This latter also acts as a guide for the movement of said presser member. Usual gasket members (not shown) act on the rod so as not to allow the oil to escape from the channel 18 into a chamber 23 within which the head 24 of the piston 21 comprising the rod 22 moves. This head (not associated in any manner with other internal members of the mandrel) peripherally supports known seal means 25 cooperating with the wall of the chamber 23. This latter communicates with a duct 27 provided in the end element 4, which is connected to the outside of the mandrel via a valve member 30, for example a non-return valve. By means of this valve the duct 27 can be connected to an external (ie external to the mandrel) source of pressurized fluid, such as air (of known type and hence not shown).

Via a duct 31 provided within the element 7, the chamber 23 communicates with a further chamber 33 present between this element and the element 3. The chamber 33 is connected to the outside of the mandrel via a vent duct 34 which does not intercept the oil duct 11.

FIGS. 2*a* and 2*b* shows a modification of the mandrel of FIGS. 1*a* and 1*b*

In this figure (in which parts corresponding to those of FIGS. 1*a* and 1*b* are indicated by the same reference numerals), the piston 21 is replaced by a hydraulic bellows 37 comprising a hollow bellows portion 38 fixed via its free end 40 to the element 7 (so as to seal against this latter) and also fixed to a head identical to said head 24 (and hence indicated by the same reference numeral). The internal cavity 38 of the bellows 37 communicates with the duct 18 and hence contains oil. Finally, about the bellows there are provided guide means 45 (for example straight bars or a cylindrical member) associated with the head 24 and guidedly slidable within one or more cavities 46 formed in the element 7.

In use, to achieve surface deformation of the mandrel, ie the withdrawal of the covering 8 from the tubular elements 5 and 6 (in order to lock a sleeve which had been mounted on it when the covering was still adjacent to these elements), compressed air is fed into the duct 27. This air passes into the chamber 23 and acts on the head 24 of the piston or hydraulic bellows 37, which has a considerably greater cross-section than that of the rod 22 or bellows portion 38. The air presses against this head and the piston 20 (or bellows 37) moves guidedly within the chamber 23. In the case of the piston, the rod 22 penetrates into the channel 18 and pressurizes the oil present therein. This pressure is transferred to the oil in the chambers 10, resulting in the withdrawal of the covering 8 from the elements 5 and 6.

By deforming (in the sense of undergoing swelling), the covering comes into contact with the sleeve and couples it to the mandrel in a manner torsionally rigid therewith. At this point the air feed to the duct 27 is halted, but the air within the mandrel remains under pressure because of the valve 30, which does not allow it to escape from said duct.

The head 24 is able to move within the chamber 23 because this chamber is connected to the chamber 33 (via the duct 31) and this latter is connected to the outside (via the duct 34), this connection enabling the air present in the chamber 23 and pressurized by the head 24 to discharge to the outside of the mandrel.

Vice versa, to release the oil pressure within the chamber 10 (for example to separate the sleeve from the mandrel), the valve 30 is acted on to connect the duct 27 to the outside. The air within this duct can hence discharge to the outside of the mandrel and the pressure of the oil present in the duct 18 returns the head 24 to its rest position in proximity to or in contact with the element 4.

The mandrel according to the invention is of simple construction and of safe and reliable use in that the oil "circuit" within it can be sealed after being charged (via the duct 13 and the member 15). Hence any risk of oil leakage from the mandrel during its use is reduced to a minimum.

In addition, the compressed air used to operate the presser means 20 can be easily maintained within the mandrel without danger of leakage, contrary to the oil previously used in known arrangements. Moreover, in these latter arrangements, successive feeding of oil into and its discharge from the mandrel via external hydraulic circuits can cause partial blocking of the mandrel non-return valve (through which this oil passes) because of possible pieces of metal present in the oil circuit due to the machining of the ducts and chambers containing the incompressible fluid within the mandrel, said pieces being carried by the oil into said valve on releasing the pressure from these chambers. This problem is not encountered in the present invention because the air (or other fluid is not in direct contact with the incompressible fluid.

Two embodiments of the invention have been described. Others are however possible in the light of the present document and are therefore to be considered as falling within the scope of the present invention.

I claim:

1. A printing cylinder mandrel for supporting a printing sleeve to be mounted thereon, the printing sleeve being of a type carrying print characters, the mandrel being surface-deformable and able to assume at least two configurations, in one configuration of the mandrel the sleeve can be selectively mounted on the mandrel and unmounted from the mandrel and in the other configuration of the mandrel the sleeve is torsionally locked to the mandrel, the mandrel comprising:

a core having an outer surface, said core including a first end element and a second end element disposed opposed to said first end element, a central element disposed between said end elements, a first tubular element connected to said central element and said first end element, and a second tubular element connected to said central element and said second end element;

a deformable element having an inner surface disposed to oppose said outer surface of said core, said central element and said tubular elements being covered with said deformable element;

a plurality of intercommunicating perimetral chambers defined between said outer surface of said core and said inner surface of said deformable element, said chambers being configured to contain an incompressible fluid, said central element defining a channel configured for containing said incompressible fluid, said central element defining at least two ducts connected to said perimetral chambers and to said channel and configured for containing said incompressible fluid; and a presser means for pressurizing said fluid in order to achieve the surface deformation of the mandrel and the torsional coupling and locking of the sleeve, said presser means being guidedly movable within said channel and being activated by feeding a pressurized fluid into said core.

2. A mandrel as claimed in claim 1, wherein said presser means includes a piston having a rod movable within said channel.

3. A printing cylinder mandrel for supporting a printing sleeve to be mounted thereon, the printing sleeve being of a type carrying print characters, the mandrel being surface-deformable and able to assume at least two configurations, in one configuration of the mandrel the sleeve can be selectively mounted on the mandrel and unmounted from the mandrel and in the other configuration of the mandrel the sleeve is torsionally locked to the mandrel, the mandrel comprising:

a core having an outer surface;

a deformable element having an inner surface disposed to oppose said outer surface of said core;

a plurality of intercommunicating perimetral chambers defined between said outer surface of said core and said inner surface of said deformable element, said chambers being configured to contain an incompressible fluid;

a channel connected to said perimetral chambers and configured for containing said incompressible fluid; and a presser means for pressurizing said fluid in order to achieve the surface deformation of the mandrel and the torsional coupling and locking of the sleeve, said presser means being guidedly movable within the mandrel and being activated by feeding a pressurized fluid into the mandrel, said presser means including a hydraulic bellows having a hollow bellows portion communicating with said channel.

4. A mandrel as claimed in claim 3, wherein:

said core includes a first end element and a second end element disposed opposed to said first end element, a central element disposed between said end elements, a first tubular element connected to said central element and said first end element, and a second tubular element connected to said central element and said second end element, said central element and said tubular elements being covered with said deformable element, said channel being defined in said central element, said central element defining at least two ducts connected to said perimetral chambers and to said channel and configured for containing said incompressible fluid.

5. A mandrel as claimed in claim 3, wherein said bellows portion of said hydraulic bellows defines a free end and said bellows portion being sealably connected at said free end to said central element.

6. A mandrel as claimed in claim 5, further comprising:

at least two cavities defined in said central element; and rigid guide means associated with said hydraulic bellows and movable within said cavities in order to guide the movement of said bellows.

7. A printing cylinder mandrel for supporting a printing sleeve to be mounted thereon, the printing sleeve being of a type carrying print characters, the mandrel being surface-deformable and able to assume at least two configurations, in one configuration of the mandrel the sleeve can be selectively mounted on the mandrel and unmounted from the mandrel and in the other configuration of the mandrel the sleeve is torsionally locked to the mandrel, the mandrel comprising:

a core including a first end element and a second end element disposed opposed to said first end element, a central element disposed between said end elements, a first tubular element connected to said central element and said first end element, and a second tubular element connected to said central element and said second end element;

a deformable element disposed to cover said central element and said tubular elements;

a plurality of intercommunicating perimetral chambers defined between said deformable element and said central element and between said deformable element and said tubular elements, said chambers being configured to contain an incompressible fluid;

a channel defined in said central element and configured for containing said incompressible fluid, said central element further defining at least two ducts connected to said perimetral chambers and to said channel and configured for containing said incompressible fluid;

a presser means for pressurizing said fluid in order to achieve the surface deformation of the mandrel and the torsional coupling and locking of the sleeve, said presser means being guidedly movable within said channel and being activated by feeding a pressurized fluid into the mandrel;

a first chamber defined between said first end element and said central element;

a first duct connecting said first chamber to the outside of the mandrel;

a non-return valve connected to said first duct; and wherein said presser means includes a large-surface portion movably disposed within said first chamber.

8. A mandrel as claimed in claim 7, further comprising:

a second chamber defined between said central element and said second end element;

a vent duct connecting said second chamber to the outside of the mandrel; and a second duct defined in said central element and communicating between said first chamber and said second chamber.

9. A mandrel as claimed in claim 8, further comprising:

at least two channels defined in said second end element and connected to said perimetral chambers;

an incompressible fluid feed duct connected to said at least two channels defined in said second end element; and a non-return valve connected to said incompressible fluid feed duct.

* * * * *